US012535067B2

(12) United States Patent
Wallace

(10) Patent No.: US 12,535,067 B2
(45) Date of Patent: Jan. 27, 2026

(54) COMPRESSOR VAPORIZER WITH DISCHARGE PIPE IN CRANKCASE

(71) Applicant: Advanced Flow Solutions Inc., Oklahoma City, OK (US)

(72) Inventor: Blake A. Wallace, Mustang, OK (US)

(73) Assignee: Advanced Flow Solutions Inc., Oklahoma City, OK (US)

( * ) Notice: Subject to any disclaimer, the term of this patent is extended or adjusted under 35 U.S.C. 154(b) by 0 days.

(21) Appl. No.: 18/958,349

(22) Filed: Nov. 25, 2024

(65) Prior Publication Data

US 2025/0180010 A1 Jun. 5, 2025

Related U.S. Application Data

(60) Provisional application No. 63/604,339, filed on Nov. 30, 2023.

(51) Int. Cl.
*F04B 53/06* (2006.01)
*F04B 39/12* (2006.01)

(52) U.S. Cl.
CPC ..... *F04B 53/06* (2013.01); *F04B 39/128* (2013.01)

(58) Field of Classification Search
CPC ..... F04B 39/125; F04B 39/128; F04B 53/06; F04B 37/20; F04B 2201/0402; F04B 39/0016; F04B 39/06; F04B 39/123
See application file for complete search history.

(56) References Cited

U.S. PATENT DOCUMENTS

| | | | | |
|---|---|---|---|---|
| 6,694,764 | B1 * | 2/2004 | Eckstein, Jr. | A23B 4/16 92/13 |
| 2016/0123314 | A1 * | 5/2016 | Ignatiev | F04B 39/10 417/374 |
| 2018/0372087 | A1 * | 12/2018 | Hebrard | F04B 39/125 |
| 2019/0257306 | A1 | 8/2019 | Blundell et al. | |

FOREIGN PATENT DOCUMENTS

| | | | |
|---|---|---|---|
| CN | 106246503 | B | 2/2018 |
| JP | S5228711 | A | 3/1977 |
| JP | S59229072 | A | 12/1984 |
| RU | 2754489 | C1 | 9/2021 |
| RU | 2763099 | C1 | 12/2021 |

OTHER PUBLICATIONS

The International Search Report and The Written Opinion of the International Searching Authority, or the Declaration from the related PCT Application No. PCT/US2024/057266, date of mailing Feb. 5, 2025, 11 pages.

* cited by examiner

*Primary Examiner* — Anthony Ayala Delgado
(74) *Attorney, Agent, or Firm* — Tucker Ellis LLP; Michael G. Craig

(57) ABSTRACT

One or more techniques and/or systems are disclosed for a gas compressor assembly. The gas compressor assembly may be comprised of a crankcase body that encloses a crankcase chamber. This crankcase chamber may connect to an internal fluid line in a manner that allows fluid communication. The internal fluid line may be specifically designed to direct discharge gas through the crankcase body, a process which may heat any liquid accumulated in the crankcase chamber, potentially converting it into a gaseous form.

20 Claims, 3 Drawing Sheets

COMPRESSOR VAPORIZER WITH DISCHARGE PIPE IN CRANKCASE

CROSS-REFERENCE TO RELATED APPLICATIONS

This application claims priority to U.S. Provisional Patent Application Ser. No. 63/604,339, entitled COMPRESSOR VAPORIZER WITH DISCHARGE PIPE IN CRANKCASE, filed Nov. 30, 2023, which is incorporated herein by reference.

BACKGROUND

Some gas compressors need to be able to handle wet gases, which are gasses or gas mixtures that contain entrained liquids. These wet gases are often in the form of liquefied gases such as butane, propane, ammonia, refrigerants, or similar products. These substances are frequently managed at or near their vapor pressure, implying they are likely to exist in both liquid and vapor states under certain conditions. Liquefied gases, depending on pressure and temperature, can transition between liquid and vapor forms. For example, propane, like all liquefied gases, has a specific vapor pressure curve that indicates the point of transition between its liquid and vapor states. This transition is influenced by factors such as temperature and/or pressure within a system, and can lead to condensation of liquids within a system.

In gas compressors that handle wet gases, challenges arise. For example, a mixture of methane, propane, butane, and pentane can exist under conditions where some constituents remain in liquid form due to different vapor pressures. In some scenarios, components like butane and pentane, with lower vapor pressures, might be entrained in the flowing gas stream in a liquid state. In these situations, oil-lubricated gas compressors may be subject to crankcase oil dilution, where entrained liquids mix with and dilute the crankcase oil, potentially leading to lubrication failures. To mitigate this issue, oil-less compressor designs can have permanently sealed bearings. However, these designs still confront challenges like liquid accumulation in the crankcase, leading to issues like liquid splashing, increases in power consumption, and bearing lubrication degradation. In some situations, liquid accumulation can cause "liquid slugging," where the piston is obstructed by the non-compressible liquid, often resulting in mechanical damage. Therefore, in wet gas applications, monitoring and periodic draining of the liquid level inside the crankcase of an oil-less compressor is often used to mitigate these situations.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In one implementation a crankcase compressor assembly can comprise a crankcase body that encloses a crankcase chamber. In this implementation, a tube or pipe can be disposed through the crankcase chamber, wherein the tube is fluidly coupled to a compressed gas discharge port of the compressor. In this way, heated compressed gas passes through the tube, which passes through the crankcase chamber. Liquid disposed in the crankcase chamber is thus heated by the tube, resulting in conversion of the liquid into a gas. In this way, a level of liquid in the crankcase chamber can be reduced during operation, mitigating issues that may arise from accumulation of liquid in the compressor crankcase chamber.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

What is disclosed herein may take physical form in certain parts and arrangement of parts, and will be described in detail in this specification and illustrated in the accompanying drawings which form a part hereof and wherein.

DETAILED DESCRIPTION

Figure 1A:
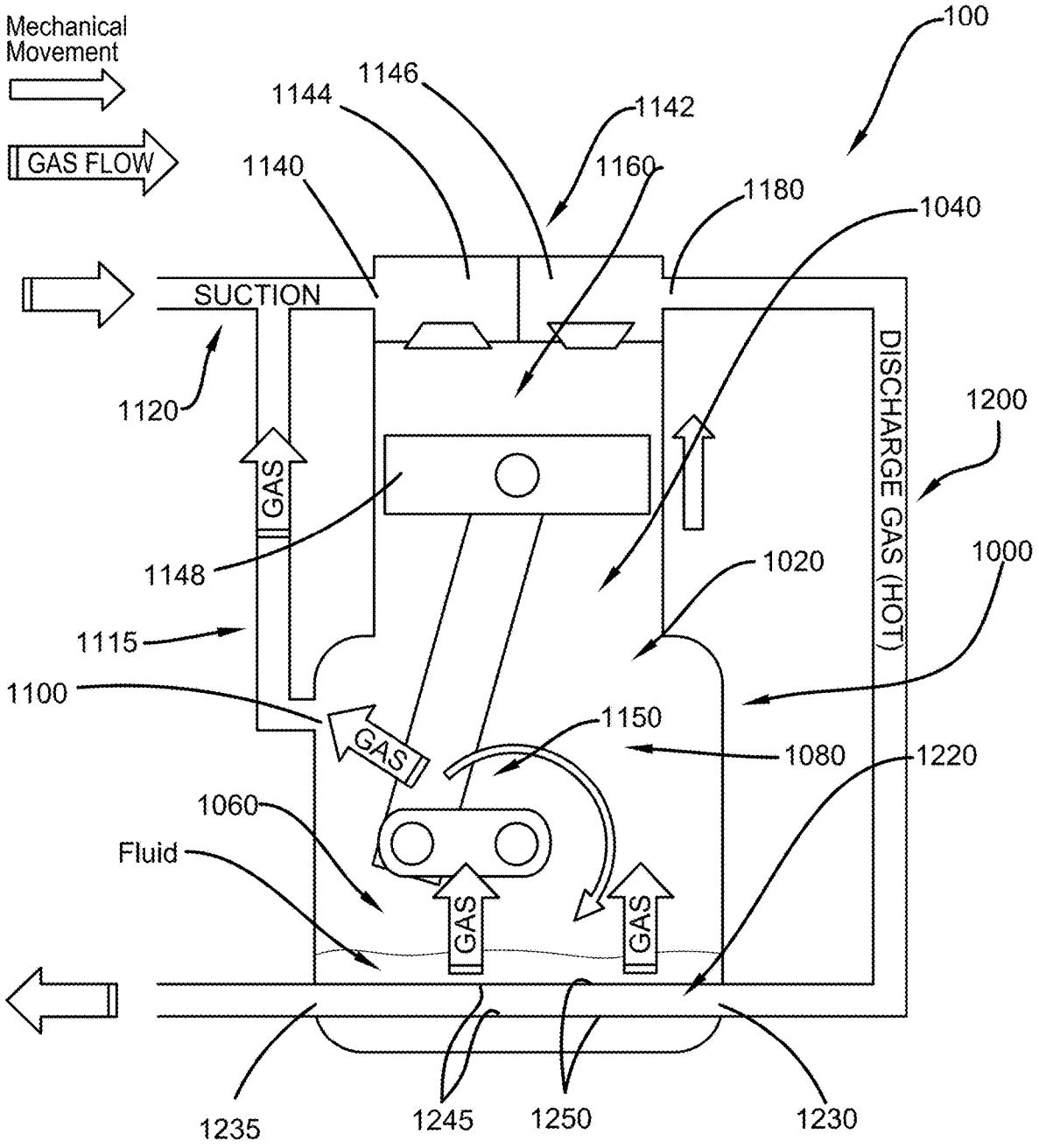
FIG. 1A is a cross sectional view of a compressor vaporizer system.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

Figure 1B:
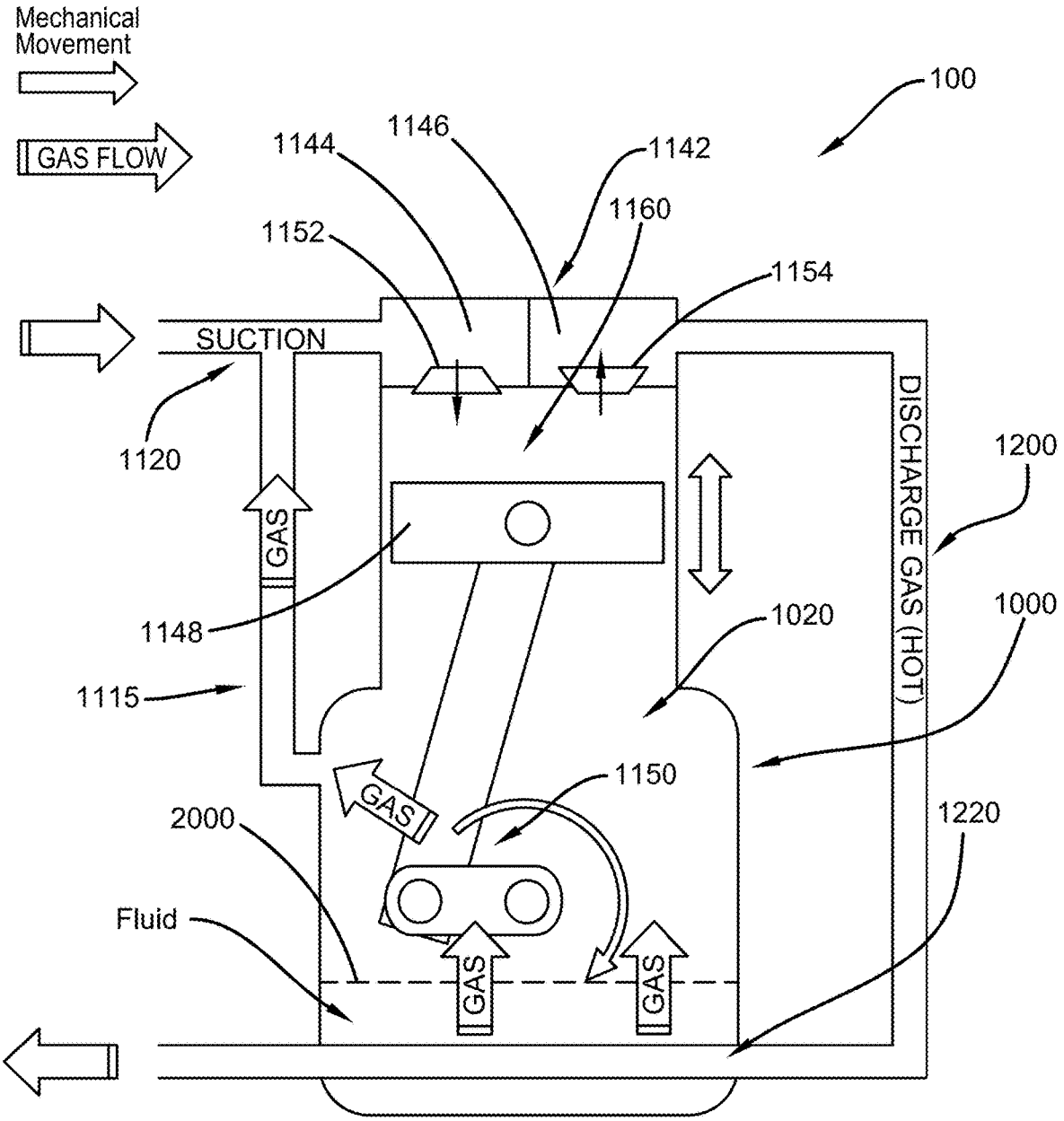
FIG. 1B is a cross sectional view of a compressor vaporizer system.

FIGS. 1A and 1B illustrate one implementation of a vaporizer discharge pipe system. The system integrates a number of components for improved operation, reduced maintenance, reduced energy usage, and reduced component failure. The system may comprise one or more of the following features, which are further described herein.

In one implementation of the present disclosure, a compressor assembly 100 is provided. The assembly 100 may comprise a crankcase body 1000 with an exterior surface. The crankcase body 1000 at least partially encloses a crankcase chamber 1020, disposed therein. The crankcase chamber 1020 comprises a top inner portion 1040, a bottom inner portion 1060 opposite to the top inner portion 1040, and an inner intermediary portion 1080 connecting the top inner portion (1040) to the bottom inner portion 1060. The crankcase chamber 1020 comprises an internal volume. The crankcase chamber 1020 can be connected to and in fluid communication with a first opening 1100 on the crankcase body 1000. The first opening 1100 is in fluid communication with a vent line 1115. The vent line 1115 is in fluid communication with an upstream suction line 1120. The suction line 1120 can be connected to and in fluid communication with a suction inlet 1140, and the suction inlet 1140 is disposed downstream of the suction line 1120.

The suction inlet 1140 is upstream in fluid communication with a cylinder head 1142, which comprises an inlet portion 1144 and an outlet portion 1146. The cylinder head 1142 is coupled with and in fluid communication with a first cylinder 1160 (e.g., piston cylinder), which is downstream of the suction inlet 1140 and inlet portion 1144. The first cylinder 1160 is coupled with the crankcase body 1000. A discharge outlet 1180 is coupled with and in downstream fluid communication with the outlet portion 1146 of the cylinder head 1142, and downstream from the first cylinder 1160. The discharge outlet 1180 is disposed in the outlet portion 1146 of the cylinder head 1142. The discharge outlet 1180 is configured to receive and transfer discharge gas from the outlet portion 1146 of the cylinder head 1142, which receives gases from the first cylinder 1160, into a coupled discharge line 1200. The discharge line 1200 is connected to, and in downstream fluid communication with, the discharge outlet 1180. In this implementation, the discharge line 1200 continues from the discharge outlet 1180, through one wall of the crankcase body 1000, through the crankcase chamber 1020, and out through a second wall of the crankcase body 1000. The portion of the discharge line 1200 that runs through the crankcase chamber 1020 comprises an internal fluid line 1220.

The internal fluid line 1220 is fluidly sealed from communication with the crankcase chamber 1020. For example, the internal fluid line 1220 can be formed from a pipe or tube, or the like, and intersect, and be disposed through, a first opening 1230 in the wall of the crankcase body 1000, extend through the crankcase chamber 1020, and intersect, and be disposed through, a second opening 1235 in the wall of the crankcase 1000. During operation, for example, the internal fluid line 1220 can internally route heated discharge gas from the discharge line 1200 through the crankcase chamber 1020 without mixing the discharge gas with the fluid in the crankcase chamber 1020. The internal fluid line 1220 can further comprise an inner surface 1245 and outer surface 1250 wherein the inner surface 1245 houses and exchanges heat with the discharge gas, the inner surface 1245 transfers the heat convectively through to the outer surface 1250, and the outer surface 1250 exchanges heat with the fluid within the crankcase chamber 1020.

As an example, the wall of the internal fluid line 1220 can function as a heat exchanger, heating the internal volume in the crankcase chamber 1020. In some implementations, this can result in the heated gas discharged from the piston cylinder to the discharge line 1200 heating the internal volume of the crankcase chamber 1020. As such, in these implementations, liquid that has collected in the in the crankcase chamber 1020 can be heated, resulting in the liquid transforming into a gas, for example, and being discharged through the vent line 1115.

In some implementations, the internal fluid line 1220 can be positioned proximate to the bottom inner portion 1060 of the crankcase chamber 1020 such that the outer surface (e.g., wall) of the internal fluid line 1220 is proximate or in direct contact with liquid that may collect or pool within the crankcase chamber 1020. In this example, the heat exchange configuration of the internal fluid line 1220 can result in heating of the liquid collected within the crankcase chamber 1020, thereby transforming it into a gaseous form, which can then be discharged through the vent line 1115. The internal fluid line 1220 may employ a pipe, coil, or involve other methods such as casting, drilling, or boring into the crankcase body 1000. The internal fluid line 1220 may be of various shapes and configurations, such as a tube, a coil, a flat plate, a pipe, a double pipe, a shell, or other heat exchanger type that provides for the hot gas in the internal fluid line to supply the latent heat used to vaporize the liquids in the crankcase chamber 1020. Furthermore, once vaporized, for example, the resulting gas may be routed back into the compressor's cylinder head inlet 1140 where it can return to the gas stream via the first opening 1100.

In another implementation, as illustrated in FIG. 1B, the compressor's crankcase assembly may further comprise a permeable baffle 2000 disposed within the crankcase body. For example, the permeable baffle 2000 can be disposed above the internal fluid line 1220. In this configuration, the baffle 2000 may allow for passage of liquids to the bottom portion 1060 of the crankcase chamber 1020, which houses the internal fluid line 1220, while allowing for vapor to pass through to a mid 1080 or top 1040 portion of the crankcase chamber 1020. In this way, vaporized liquid can be efficiently passed to the first opening 1100, and vent line 1115, aiding in the efficient vaporization of, and removal of, the liquid from the crankcase chamber 1020. Furthermore, the permeable baffle may act to mitigate movement (e.g., sloshing) of the liquid in the crankcase chamber 1020, which may be caused by movement of compressor component, such as a crankarm 1150 and piston 1148, for example. Additionally, the baffle 2000 can function to separate any accumulated liquid from the fast-moving compressor components, such as by mitigating the movement of the liquid inside the crankcase chamber 1020. Other similar components may be used to the same effect such as a mesh screen, liquid separator, demister pad, or windage tray instead or in addition to the permeable baffle 2000.

Additionally, as illustrated in FIG. 1B, in one implementation, the crankcase assembly 100 can comprise a crankarm assembly 1150 that can be operably coupled to a motor that outputs a rotating force. The rotation output results in the crankarm assembly 1150, which causes a portion of the crankarm assembly 1150 to reciprocate back and forth. In this implementation, a piston 1148 can be coupled to a distal end of the crankarm assembly 1150. The reciprocating movement of the crankarm assembly 1150 results in movement of the piston 1148 back and forth within the cylinder 1160. Further, an inlet valve 1152 can be disposed at an opening between the inlet portion 1144 of the cylinder head 1142 and the inside of the cylinder 1160. The inlet valve 1152 can comprise a one-way valve that merely allows passage of fluids (e.g., gas) from the inlet portion 1144 of the cylinder head 1142 to the inside of the cylinder 1160. An outlet valve 1154 can be disposed at an opening between the outlet portion 1146 of the cylinder head 1142 and the inside of the cylinder 1160. The outlet valve 1154 can comprise a one-way valve that merely allows passage of fluids (e.g., gas) from the inside of the cylinder 1160 into the outlet portion 1146 of the cylinder head 1142. In this way, for example, on a downstroke of the piston 1148 fluids are drawn into the inside of the cylinder 1160 from the inlet portion 1144 of the cylinder head 1142 (e.g., and suction line 1120), but not from the outlet portion 1146 of the cylinder head 1142. In this example, on an upstroke of the piston 1148 fluids are compressed and pushed into the outlet portion 1146 (and discharge line 1200) of the cylinder head 1142 from the inside of the cylinder 1160, but not into the inlet portion 1144 of the cylinder head 1142.

Figure 2:
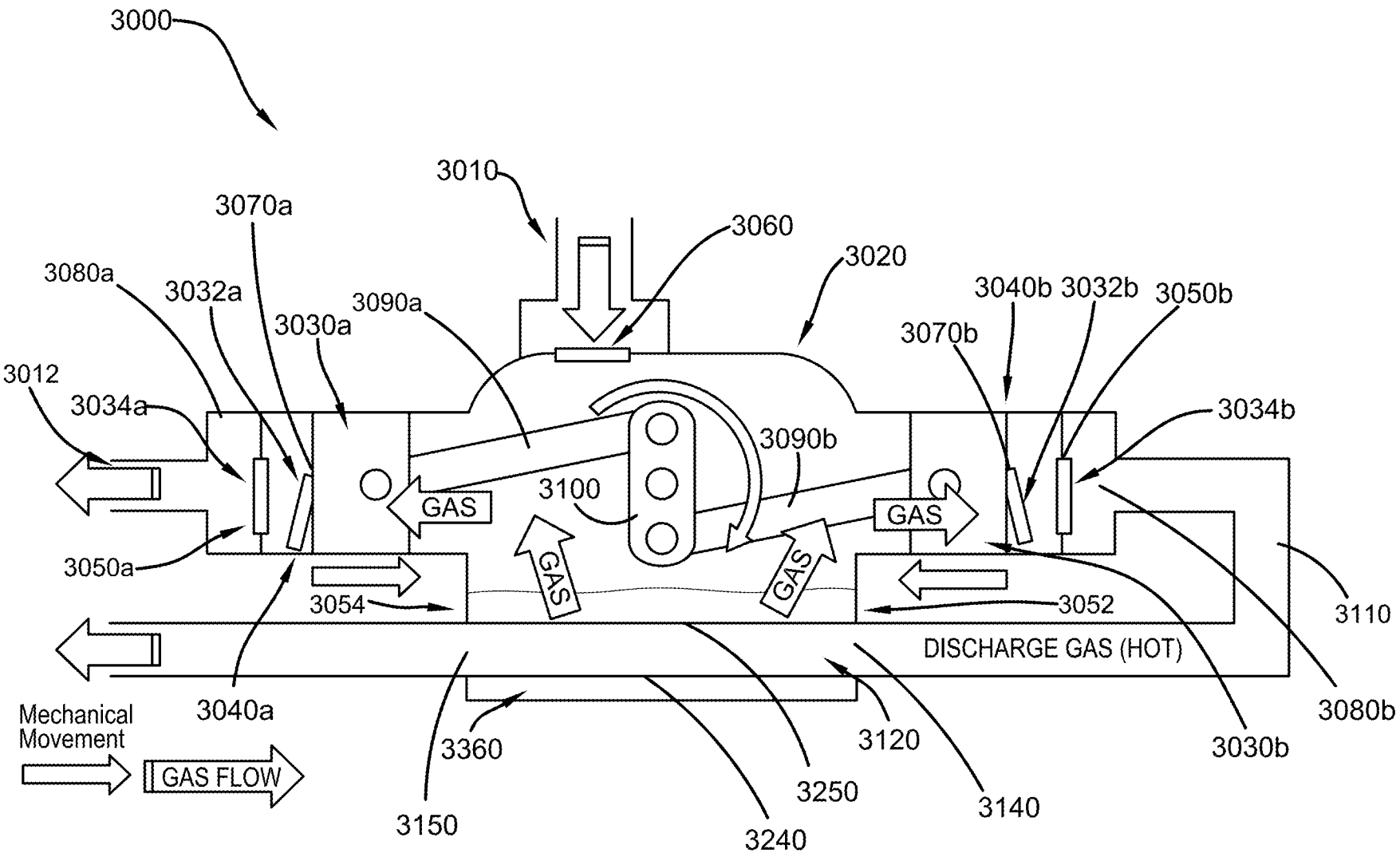
FIG. 2 is a cross sectional side view of a horizontal compressor vaporizer system comprising one or more features of the exemplary systems and methods described herein.

In one implementation of the present disclosure, as illustrated in FIG. 2, a compressor assembly 3000 may be configured such that fluid is introduced directly from a crankcase suction line 3010 into a crankcase 3020 when there is negative relative pressure in the crankcase 3020. The compressor assembly 3000 may further include a plurality of pistons 3030 reciprocally mounted in a cylinder 3040 (3040*a*, 3040*b*) connected to either end of the crankcase 3020. The compressor assembly 3000 may further comprise a transfer port 3070 (3070*a*, 3070*b*) located in/on respective pistons 3030 wherein fluid may travel through the respective pistons 3030, out a first piston suction valve 3032 (3032*a*, 3034*b*) and into the cylinder 3040, wherein the transfer port 3070 is in fluid communication with and located downstream from the crankcase 3020. The compressor assembly 3000 may further comprise an exhaust port 3050 (3050*a*, 3050*b*) disposed at a downstream end of the respective cylinders 3040. The compressor assembly 3000 may further comprise an inlet suction port 3060 arranged to supply operational fluid into the crankcase 3020. The inlet suction port 3060 can comprise a one-way valve that merely allows fluid to enter into the crankcase 3020 from a fluid supply, or suction line 3010.

In this implementation, the respective cylinders 3040 may be connected to, and in fluid communication with, a cylinder head 3080 (3080*a*, 3080*b*), such that the respective cylinders 3040 can transfer fluid through their exhaust port 3050 and into their corresponding cylinder head 3080. The respective pistons 3030 can be reciprocally mounted within the cylinder 3040, and connected by a connecting rod 3090 (3090*a*, 3090*b*) to a crankshaft 3100 within the crankcase 3020. In this implementation, cylinder head 3080*b* may be in fluid communication with and upstream of a discharge gas line 3110, wherein the discharge gas line 3110 may be connecting to and in fluid communication with an internal fluid line 3120, for example, to receive gases heated by the compression action. As described above, similarly, the internal fluid line 3120 (e.g., a pipe or tube) may intersect a first opening 3140 in a first wall 3052 of the crankcase 3020, extend through the crankcase 3020, and intersect a second opening 3150 in a second wall 3054 of the crankcase 3020. During operation, for example, the internal fluid line 3120 routes heated discharge gas back through the internal fluid line 3120 inside of the crankcase 3020 without mixing the discharge gas with the fluid in the crankcase. The internal fluid line 3120 may further comprise an inner surface 3240 and outer surface 3250 wherein the inner surface houses and exchanges heat with the discharge gas, the inner surface transfers the heat convectively through to the outer surface, and the outer surface exchanges heat with the collected fluid 3360 within the crankcase 3020. In this implementation, the wall of the internal fluid line 3120 can be configured to act as a heat exchange, and the fluid inside the crankcase 3020 can be heated. The heated fluid can become vaporized fluid, which may be taken up by the compressor's cylinders (e.g., through the transfer port 3070 and exhaust port 3050, thereby introducing it back to the supply.

In other implementations, the gas compressor system 3000 may enable the vaporized liquids from the crankcase 3020 to be reintroduced into a compressor inlet, facilitating a continuous and efficient cycle of vaporization and reintegration. As an example, a portion of the compressed or discharged gas may be discharged through a second discharge line 3012, which is not directed through the crankcase chamber 3020. In some implementations, the vaporized liquid passing through internal fluid line 3140 in the crankcase 3020 may consist of the full discharge stream from the compressor. In other implementations, only a portion of the discharge stream may be used to heat the liquid present in the crankcase chamber 1020. In further implementations, the gas passing through the internal fluid line 3140 may be controlled or diverted such that it only passes through the crankcase chamber when there is liquid present. In this type of implementation, various sensors and flow actuators may be used to monitor the fluid level in the crankcase chamber and to control the flow of discharge gas. Such sensors may include differential pressure flow sensors, thermal mass flow sensors, pitot sensors, venturi sensors, target flow sensors, or other similar sensors. Flow actuators may include pneumatic actuators, hydraulic actuators, electro-hydraulic, and electric motor operated valves.

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A gas compressor assembly comprising:

a crankcase body and a crankcase chamber disposed within the crankcase body;

a piston cylinder coupled with the crankcase body, wherein the crankcase chamber is fluidly coupled with the piston cylinder;

a cylinder head comprising an inlet portion and an outlet portion, the cylinder head coupled to the piston cylinder, wherein an interior of the piston cylinder is fluidly coupled with the cylinder head; and a discharge line fluidly coupled with the outlet portion of the cylinder head, the discharge line comprising an internal fluid line portion that is fluidly coupled with the discharge line, wherein the internal fluid line runs through the crankcase chamber, wherein the gas compressor assembly is configured to operably route discharge gas from the outlet portion of the cylinder head through the crankcase chamber in the internal fluid line portion.

2. The crankcase compressor assembly of claim 1, wherein the internal fluid line portion is configured to receive heated discharge gas, and wherein a wall of the internal fluid line portion is configured to act as a heat exchange between the heated discharge gas and the crankcase chamber, resulting in an increase in temperature in the crankcase chamber.

3. The crankcase compressor assembly of claim 1, further comprising a permeable baffle disposed within the crankcase body, configured to mitigate movement of liquid.

4. The crankcase compressor assembly of claim 1, comprising a suction line fluidly coupled with the inlet portion of the cylinder head and operable to provide supply fluid to the cylinder head.

5. The crankcase compressor assembly of claim 4, comprising a vent line fluidly coupled with and between the crankcase chamber and the suction line, operable to draw fluid from the crankcase chamber to the suction line.

6. The crankcase compressor assembly of claim 1, comprising a crankcase inlet that operably provides fluid supply to the crankcase chamber.

7. The crankcase compressor assembly of claim 1, the inlet portion and outlet portion of the cylinder head fluidly separated from each other, and respectively, fluid coupled to the cylinder, wherein the inlet portion comprises a one-way valve that merely allows flow from the inlet portion to the cylinder, and the outlet portion comprises a one-way valve to merely allow flow from the cylinder to the outlet portion.

8. The crankcase compressor assembly of claim 1, comprising at least two piston cylinders fluidly coupled with the crankcase chamber.

9. The crankcase compressor assembly of claim 8, where respective piston cylinders comprise a piston that comprises a transfer port between the crankcase chamber and the piston cylinder, and an exhaust port between the piston cylinder and the cylinder head.

10. The crankcase compressor assembly of claim 9, wherein the respective exhaust ports comprise a one-way valve that merely allows flow into the cylinder head from piston cylinder.

11. The crankcase compressor assembly of claim 9, wherein respective transfer ports comprise a one-way valve that merely allows flow into the piston cylinder from the crankcase chamber.

12. A compressor assembly comprising:

a crankcase body comprising an interior wall, the interior wall defining a crankcase chamber disposed therein;

a fluid inlet in fluid communication with the crankcase chamber and configured to introduce uncompressed fluid into the compressor assembly;

a fluid outlet disposed downstream from the fluid inlet, and configured to receive compressed gas from the compressor assembly; and a discharge line fluidly coupled with the fluid outlet, wherein a portion of the discharge line is routed through the interior wall of the crankcase body, through the crankcase chamber, and out from the interior wall of the crankcase body, such that the portion of the discharge line runs through the crankcase chamber and is fluidly sealed from the crankcase chamber;

wherein the portion of the discharge line is configured to act as a heat exchanger to exchange heat with the interior of the crankcase body.

13. The compressor assembly of claim 12, further comprising a permeable baffle disposed within the crankcase body, configured to mitigate movement of liquid.

14. The compressor assembly of claim 12, comprising a suction line fluidly coupled with the fluid inlet portion and operable to provide supply fluid to a cylinder head of a piston cylinder coupled to the crankcase chamber.

15. The compressor assembly of claim 14, the cylinder head comprising the fluid outlet portion that is fluidly coupled with the piston cylinder.

16. The crankcase compressor assembly of claim 12, the fluid inlet fluidly coupled with the crankcase chamber.

17. The crankcase compressor assembly of claim 16, comprising at least two piston cylinders fluidly coupled with the crankcase chamber.

18. The crankcase compressor assembly of claim 17, where respective piston cylinders comprise a piston that comprises a transfer port between the crankcase chamber and the piston cylinder, and an exhaust port between the piston cylinder and the cylinder head.

19. The crankcase compressor assembly of claim 18, wherein:

the respective exhaust ports comprise a one-way valve that merely allows flow into the outlet portion from piston cylinder; and the respective transfer ports comprise a one-way valve that merely allows flow into the piston cylinder from the crankcase chamber.

20. A gas compressor system comprising:

a compressor having an inlet and an outlet;

a crankcase in fluid communication with the inlet and comprising an internal crankcase chamber;

a discharge line fluidly coupled with the outlet, a portion of the discharge line comprising an internal fluid line, wherein the internal fluid line is sealedly disposed within the crankcase and configured to receive and route hot discharge gas from the outlet through the crankcase chamber and to act as a heat exchanger between the discharge line and the crankcase chamber; and a permeable baffle positioned inside the crankcase chamber, proximate the internal fluid line.

* * * * *